US005749696A

United States Patent [19]

Johnson

[11] Patent Number: 5,749,696

[45] Date of Patent: May 12, 1998

[54] HEIGHT AND TILT INDICATOR FOR FORKLIFT TRUCK

[75] Inventor: Marc Johnson, Olathe, Kans.

[73] Assignee: Scott Westlake, Overland Park, Kans.

[21] Appl. No.: 594,378

[22] Filed: Jan. 30, 1996

Related U.S. Application Data

[63] Continuation of Ser. No. 919,051, Jul. 23, 1992, abandoned.

[51] Int. Cl.[6] ..... B66F 9/06

[52] U.S. Cl. ..... 414/635; 414/266; 414/273; 414/281; 189/9 E

[58] Field of Search ..... 414/273–277, 414/281–286, 631–634, 638, 642; 189/9 R, 9 E, 29.2

[56] References Cited

U.S. PATENT DOCUMENTS

| | | | |
|---|---|---|---|
| 3,531,705 | 9/1970 | Rosin et al. | 414/273 |
| 3,786,929 | 1/1974 | Hathcock, Jr. | 414/273 |
| 4,037,731 | 7/1977 | Reis et al. . | |
| 4,447,186 | 5/1984 | Renfro et al. . | |
| 4,491,918 | 1/1985 | Yuki et al. . | |
| 4,499,541 | 2/1985 | Yuki et al. | 364/424 |
| 4,516,116 | 5/1985 | White | 340/685 |
| 4,549,845 | 10/1985 | Ramsey, Jr. . | |
| 4,632,630 | 12/1986 | Maki et al. . | |
| 4,747,610 | 5/1988 | Yingling et al. . | |
| 4,826,474 | 5/1989 | Holmes . | |
| 4,861,223 | 8/1989 | Olson | 414/280 |
| 4,869,635 | 9/1989 | Krahn | 414/274 |
| 4,930,975 | 6/1990 | Ito . | |
| 4,938,652 | 7/1990 | Sanderson . | |
| 4,957,408 | 9/1990 | Ohkura . | |
| 4,964,780 | 10/1990 | Karvonen . | |
| 5,011,358 | 4/1991 | Andersen et al. . | |
| 5,012,939 | 5/1991 | Pitman et al. | 212/157 |

FOREIGN PATENT DOCUMENTS

| | | | |
|---|---|---|---|
| 288704 | 12/1991 | Japan | 414/273 |
| 3288704 | 12/1991 | Japan . | |

*Primary Examiner*—Karen B. Merritt
*Assistant Examiner*—Raymond B. Johnson
*Attorney, Agent, or Firm*—Kokjer, Kircher, Bowman & Johnson

[57] ABSTRACT

A tilt and height indicator for a forklift truck including a tape reel connected to the forks of the forklift to sense their relative height. An indicator panel includes plural sets of indicators, with each set indicating when the forks are in a proper pre-programmed position, just above, or just below this position, or well above or well below this position. The plural indicators may each be programmed to independent heights which are within the range of indicated heights for another indicator, such that infinitesimal differences in shelf heights may be accounted for. All indicators may be active at the same time, or the operator may change to a separate mode in which only a chosen indicator set is active. The present invention also includes a tilt sensor in the form of a rod connected to the piston of the tilt cylinder and adjustably mounting a magnet. A sensor box is mounted on the cylinder and includes a plurality of spaced Hall-effect transistors. The location of the magnet with respect to the transistors is dependant upon the relative position of the mast and chassis, such that the magnet on the rod will be in proximity to various ones of the transistors, thus activating those transistors. The indicator panel may include a tilt display having a plurality of indicators corresponding to the transistors to provide an accurate indication of the tilt condition of the mast.

7 Claims, 3 Drawing Sheets

HEIGHT AND TILT INDICATOR FOR FORKLIFT TRUCK

This is a continuation of application Ser. No. 07/919,051, filed Jul. 23, 1992, now abandoned.

BACKGROUND OF THE INVENTION

1. Field of the Invention

The present invention relates in general to industrial lift trucks such as forklift trucks. In particular, the present invention relates to an improved device for indicating the tilt position of the mast and the height of the forks of the forklift relative to preset heights.

2. Description of the Related Art

It has long been known to employ lift trucks such as forklift trucks for the moving and placement of objects in an industrial and warehouse setting. During the typical day a forklift operator will move palletized loads between various locations, often moving the loads among various repetitive heights while maintaining the mast of the forklift in a level configuration.

To increase productivity it has been known to provide devices which will assist the operator in quickly moving the forks to a predetermined height, such as one or more shelf levels within a warehouse. One commercial device marketed by Marco Engineering, Inc. provides a system that automatically controls the raising and lowering of the forks to the selected height corresponding to programmed shelf heights. Such automatic control devices are relatively expensive, and the automatic raising and lowering of the forks may lead to inadvertent damage or injury.

Another device is disclosed in U.S. Pat. No. 5,011,358 to Anderson et al. This device includes a tape reel to sense the height of the forks, a Murphy-type switch used as a tilt sensor and a programmable display panel. The display panel allows the operator to store various fork heights under associated shelf level numbers. Associated with each shelf level are store and retrieve heights, approximately ten centimeters (4 in.) apart. For each of the store and retrieve heights there are provided three light indicators, above, indicating that the forks are above the desired position, exact, indicating the fork are in the desired position, and below, indicating that the forks are below the desired position.

As the user raises the forks from their lowest to their highest position, the tape reel will unwind to sense this motion of the forks. The display panel will automatically display the number of each shelf level as the forks enter a predetermined range above and below the programmed store and retrieve heights for that level, and will cycle through the low, exact and high indicators for these retrieve and store heights. While this arrangement is suitable for some applications, the ability to display only a single shelf level at a time imposes limitations.

Specifically, a single shelf level is associated with the range of heights between the low level of the retrieve position and the high level of the store position, with this distance being typically on the order of 18 cm (six inches). Since only a single shelf level can be displayed at a time, each of the shelf level ranges must be discrete and not overlap, i.e. they must be at least 18 cm apart. Where two different shelves are at different heights but within this 18 cm range, there is no possibility to display the proper heights for both of the shelves. This will limit a particular fork lift to being used only with particular shelves which have a height difference greater than the pre-determined range for each shelf level.

SUMMARY OF THE INVENTION

It is an object of the present invention to provide a device to assist in the proper location of a load by a forklift truck.

Another object of the present invention is to provide a device which will accurately indicate to a forklift operator when the forks are at a proper and desired height.

Another object of the present invention is to provide such a device which will not impose limits on the spacing between such desired heights.

Yet another object of the present invention is to provide a height indicator for forklift truck which includes a plurality of height indicators.

Another object of the present invention is to provide an indication to the operator of the tilt of the mast of the forklift.

A further object of the present invention is to provide an improved tilt sensor for a forklift mast.

These and other objects of the present invention are achieved by a tilt and height indicator for a forklift truck having a tape reel connected to the forks of the forklift to sense their relative height. An indicator panel includes plural sets of lights, with each set indicating when the forks are in a proper pre-programmed position, just above or just below this position, or well above or well below this position. The plural indicators may each be programmed to independent heights which are within the range of indicated heights for another indicator, such that infinitesimal differences in shelf heights may be accounted for. All indicators may be active at the same time, or the operator may change to a separate mode in which only a chosen indicator is active. The present invention also includes a tilt sensor in the form of a rod connected to the piston of the tilt cylinder and adjustably mounting a magnet. A sensor box is mounted on the cylinder and includes a plurality of spaced Hall-effect transistors. The location of the magnet with respect to the transistors is dependant upon the relative position of the mast and chassis, such that the magnet on the rod will be in proximity to various ones of the transistors, thus activating those transistors. The indicator panel may include a tilt display having a plurality of indicators corresponding to the transistors to provide an accurate indication of the tilt condition of the mast.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
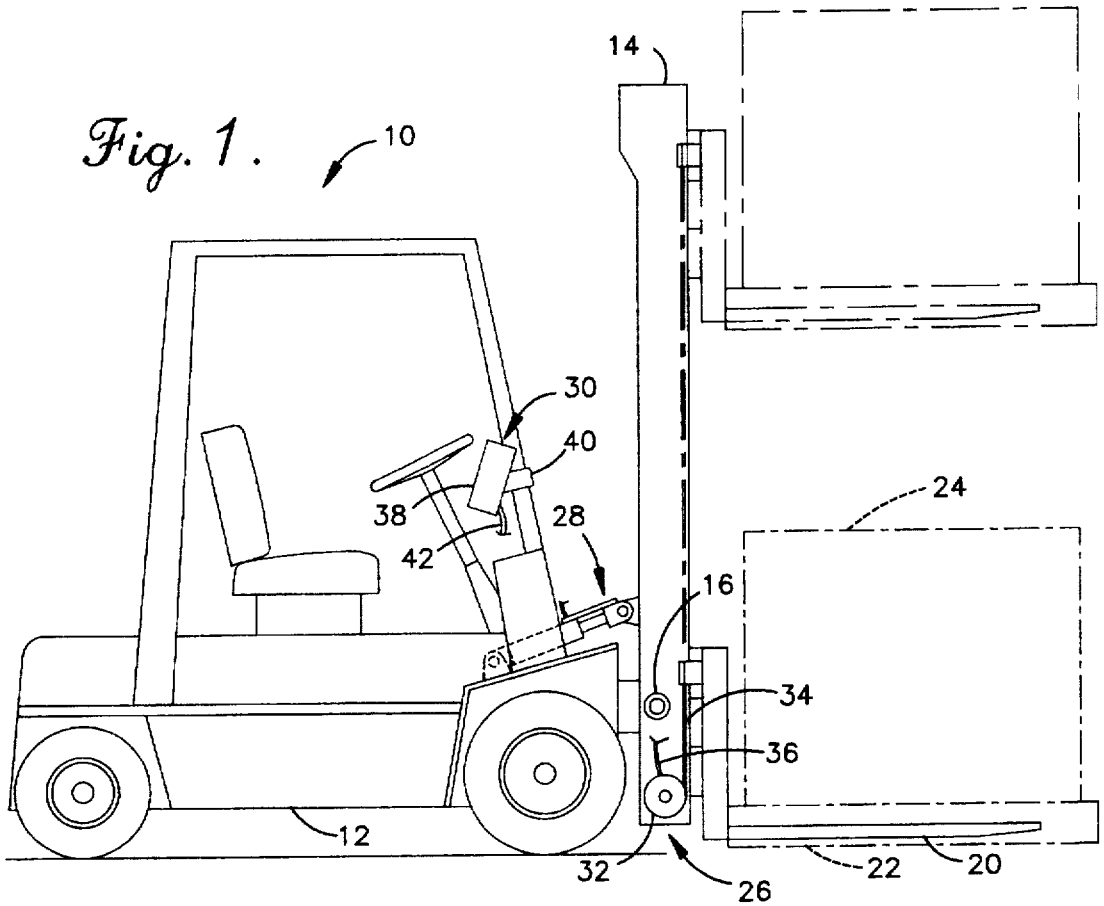
FIG. 1 is a side view of a forklift equipped with the device according to the present invention.

With reference to FIG. 1, a standard forklift is generally identified by reference numeral 10. The forklift 10 includes a chassis 12 having powered wheels for movement of the chassis. Mounted to the forward end of the chassis is a mast 14 which may pivot with respect to the chassis 12 near its lower end about a revolute joint 16. This tilting of the mast with respect to the chassis is controlled by a tilt cylinder 18 as is known in the art. A pair of forks 20 are mounted for vertical sliding movement along the mast 14, with an additional cylinder provided to effect such movement. As is known in the art, the forks 20 may be inserted within a pallet 22 which supports a load 24 and the forks may thereafter be lifted to raise the pallet and load for movement to a shelf at a different vertical height.

Figure 6:
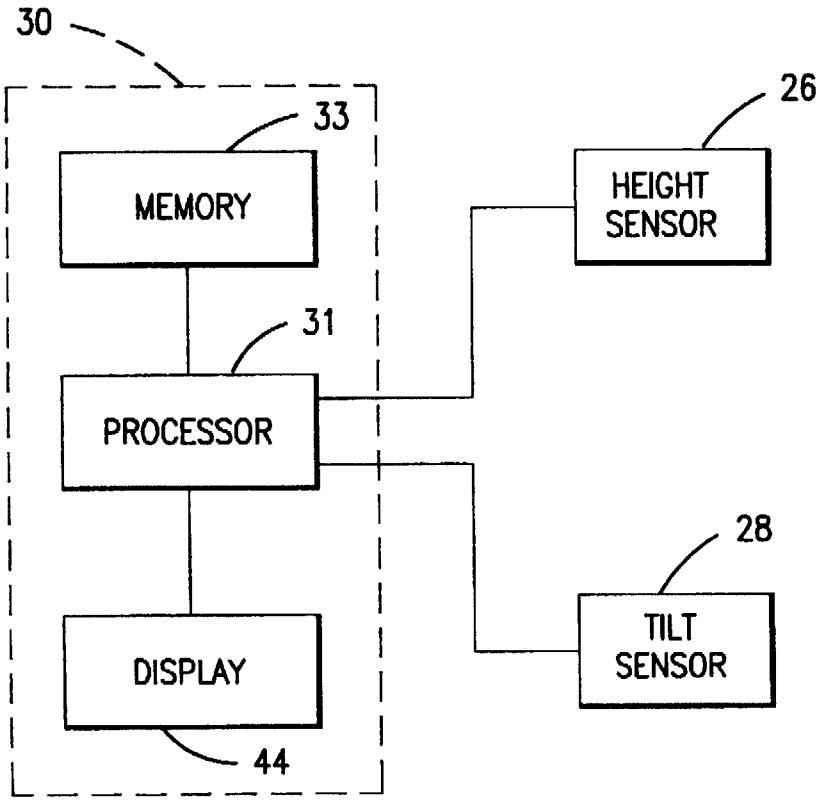
FIG. 6 is a block diagram showing the controller and sensors of the present invention.

The device according to the present invention mounts upon such a forklift truck and generally consists of a height sensor 26, a tilt sensor 28 and a programming and display unit 30 comprising a processor 31, a memory 33, and a display 44, as shown in FIG. 6.

The height sensor 26 includes a tape reel 32 housing a retractable tape 34. The reel will include appropriate biasing means such that the tape may be withdrawn from the reel, and wound back thereon, while maintaining the tape in a taut condition. The free end of the tape 34 is fixed to the forks 20 such that it will travel with the forks upward and downward along the mast 14, with the amount of tape withdrawn from the reel 32 thus providing an indication of the position of the forks 20.

Various arrangements could be employed to sense the withdraw and retraction of the tape with respect to the tape reel. For example, the tape could include numerous magnetic elements along its length which are sensed within the tape reel, the tape could include slits extending therethrough which are sensed by means of a light emitter and receiver, or other means. It is also possible to sense the movement of the tape by providing an equivalent counter, magnetic, optical or other, upon the tape reel 32 to sense its rotation. In any event, the reel 32 is provided with a quadrature decoder (not shown) and appropriate electrical wiring 36 to provide communication of the tape location from the tape reel 32 to the programming and display unit 30.

The programming and display unit 30 has a generally box-like configuration formed by an outer housing 38, which is fixed to the chassis 12 of the forklift by appropriate mounting brackets 40. The unit 30 may also include appropriate electrical wiring to connect it with a power source, the unit may include an internal battery for such a purpose, or both could be employed.

Figure 2:
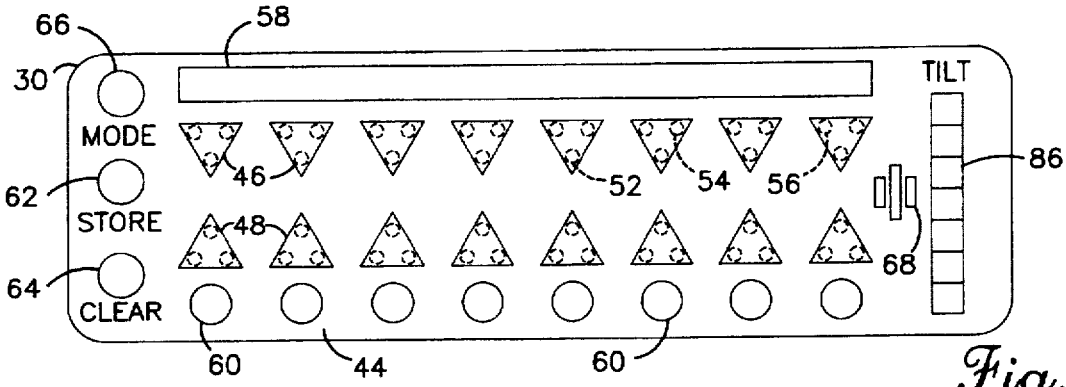
FIG. 2 is a plan view showing a display panel of the present device.

As is best shown in FIG. 2, the unit 30 includes a display panel 44 which acts as an interface with the operator of the forklift 10. The display panel 44 is preferably formed of a rugged and opaque material such as steel. The display panel includes plural sets of height indicators with each set of height indicators including an above portion 46 and a below portion 48. Each of these portions are formed of a transparent or translucent material embedded within or mounted upon the display panel.

The portions 46 and 48 of each set are intended to be illuminated from behind to provide an indication to the operator of the level of the forks 20 with respect to a particular predetermined or desired height. In particular, the above portion 46 will be illuminated when the forks are above the desired height associated with the set of height indicators, the below portion 48 will be illuminated when the forks are below such height, and both the above and below portions will be illuminated when the forks are located at this desired height.

To assist the operator in quickly determining the current position of the forks in relation to the desired position, the portions 46 and 48 preferably take the form shown in FIG. 2. In particular, the above portion is preferably located vertically above the below portion. This will provide an indication of the relative position of the forks with respect to the desired position, i.e. physically above or below the desired position.

To make the present device more intuitive, it is preferred that the above and below portions 46 and 48 have a generally arrowhead-shaped configuration, with a readily defined apex pointing towards the other of the portions. This will help to assist the operator in determining that the forks 20 must be moved downward, when too high, or upward, when too low, to achieve the exact position, and thus provides an indication of the direction of movement required to achieve the proper position.

As noted above, each of the portions is intended to be illuminated. To further assist in operation, this illumination may be in different colors. For example, it is preferred that each of the above portions and below portions 46 and 48 preferably include three bulbs behind a clear or milky white translucent panel. The bulbs preferably include a red bulb 52, green bulb 54 and a yellow bulb 56 which may be alternatively illuminated. Rather than employing three separate bulbs, a single bulb or LED could be employed so long as the three colors could be achieved.

When the forks are within a first relatively large distance from the desired position, the green bulb 54 will be illuminated to provide an indication to the operator of the relative distance to be traveled (with the location and shape providing indications of the location of the forks and the necessary direction of travel, as described above). As the forks approach the desired position they will pass through a second, lesser distance from the desired position, at which point the green bulb 54 will be extinguished and the yellow bulb 56 illuminated within the appropriate one of the indicators 46 or 48. This now provides an indication that the forks are nearing the desired position, such that the operator can slow the rate of movement of the forks. Finally, when the forks reach the desired position the single yellow bulb will be extinguished and the red bulb 52 in both of the portions 46 and 48 will be illuminated, indicating that the desired position has been reached, and no movement is required in either direction. By this arrangement the operator may quickly achieve the desired position of the forks.

As may be seen, the present arrangement of indicators thus provides an indication of the relative position of the forks with respect to the desired position, the direction of movement necessary to reach such position, and an indication of the relative distance required to be travelled to reach such position, all with only two indicator portions.

Located above the sets of height indicators is a designation strip 58 upon which may be written a specific location identifier, bin number, shelf number or other designation of the physical location and/or height associated with a particular one of the sets of height indicators. The designation strip could be formed as a piece of paper held within appropriate lips on the display panel, by a LED display or other appropriate means.

Also located on display panel 44 are various push buttons employed during the programming and operation of the device according to the present invention. In particular, there are a plurality of indicator selection buttons 60 (one associated with each set of height indicators), a store button 62, a reset button 64 and a mode button 66. Some or all of these buttons may include appropriate identifying indicia 68 associated therewith. As is known in the art, the buttons may have different colors, or be illuminated or selectively illuminated to assist in the operation of the device.

Located within the housing 38 are appropriate electronic components operatively connected to the height sensor 26 by way of the wires 36 and operatively connected to the sets of height indicators and buttons 60–66 to provide proper operation of the present device. For example, these components could include a microprocessor having as input the signals from the height sensor 26. The micro processor would be in communication with a buffer or encoder to identify activation of the various buttons. The microprocessor would be in communication with a memory, such as a PROM to receive operating instruction and to store and retrieve values, and would include appropriate switches or drivers to activate the various bulbs 52–56 of the various sets of height indicators.

Figure 5A:
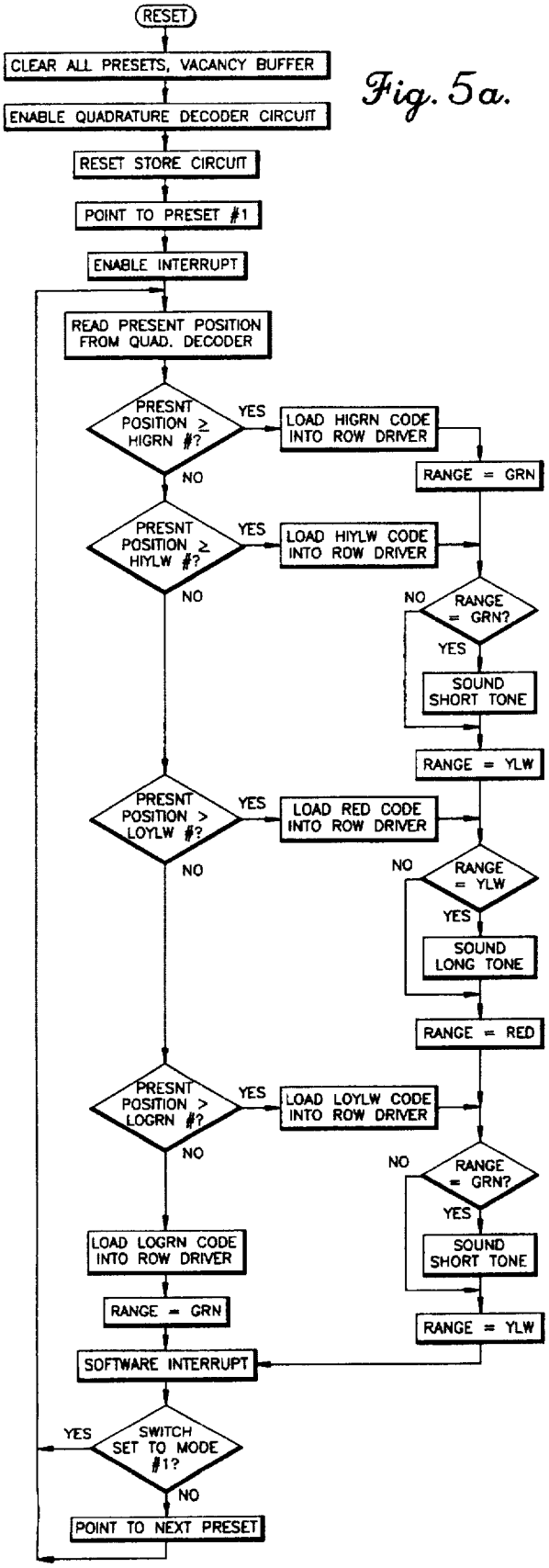
FIGS. 5*a* and 5*b* are flowcharts showing program operation according to the present device.
Figure 5B:
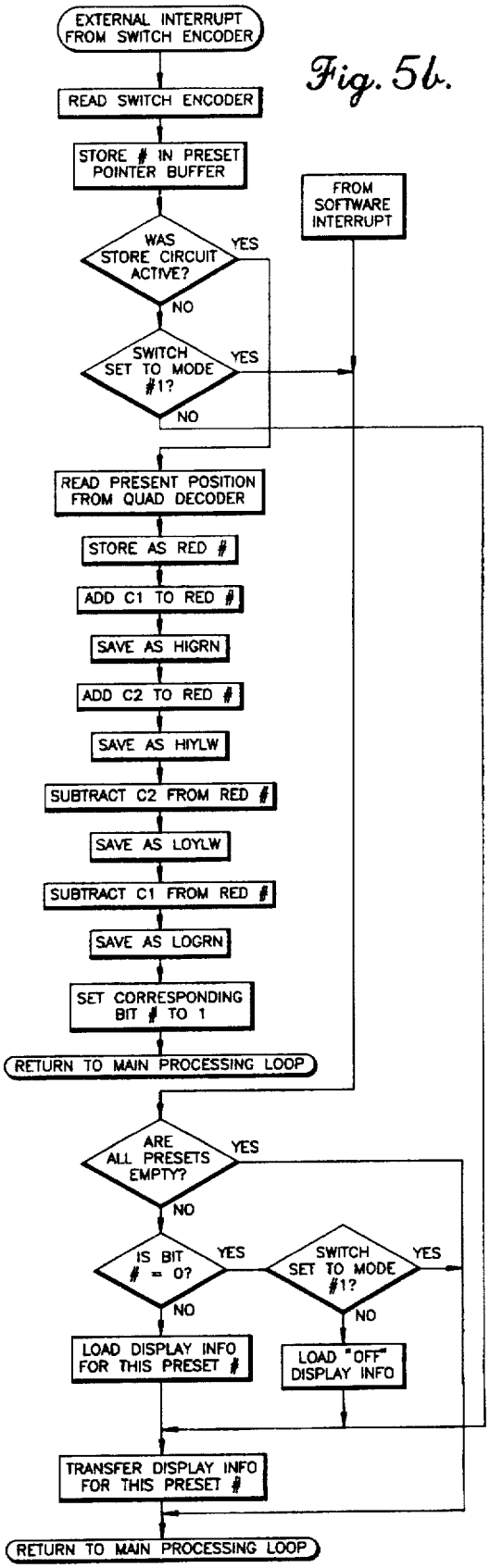

FIGS. 5*a* and 5*b* together show an operational flow chart for the microprocessor, which will be used to discuss the operation of the present device.

With reference to FIG. 5*a*, which shows a main processing loop, upon activation of a key or other switch to begin operation of the forklift 10, the electrical components of the present device are provided with operational power through wiring 42. As a first operation of the main processing loop, the microprocessor will initiate a reset to clear all variable memory, presets, buffers, etc., and will enable the height sensor 26. At this point the device is in an initial state ready for user programming. It is noted that the device may be provided with an uninterrupted power supply, permanent memory, or other arrangement, and the reset step eliminated, such that the variable information stored within the device from previous use will be maintained. This will eliminate the need to reprogram the device with each day's use.

Upon completing this initial start up sequence, the variable PRESET, indicating a particular one of the heights stored within the memory and associated with a particular indicator set, will be set to 1, and the main program loop will begin iteration, incrementing the variable PRESET by one with each pass to determine the position of the forks with respect to each possible PRESET position. However, in the current condition of the device there are no predetermined positions stored.

To save a fork position to the memory, the operator will first press the store button 62. This will cause activation of a store circuit having an internal timer and store signal generating means. When activated, which preferrably requires the store button to be depressed for 2–3 seconds to avoid accidental operation, the store circuit will generate the store signal which may be read by the microprocessor for the duration of the timer, which is preferably about thirty seconds. It is also preferred that the store circuit illuminate an indicator on the control panel, possibly illuminating the store button itself, to indicate to the operator that the device is in store mode.

Although the store circuit is active there is no impact upon the microprocessor at this point other than receiving the store signal and it continues iteration through the main loop. During these iterations there are no values stored, and as such the program displays no information.

After the store button has been depressed the thirty second store signal is intended to allow the operator time to place the forks in the desired position to be saved to memory. If no button is pressed within the 30 second time limit, the program will simply remain in the main processing loop and await a further depression of the store button. However, if one of the selection buttons 60 is depressed it causes an external interrupt, transferring operation from the main program loop of FIG. 5*a* to the interrupt subroutine of FIG. 5*b*. Within this subroutine the microprocessor retrieves the particular button number identifying the indicator with which this information will be associated, and stores this number as PRESET. The subroutine then checks to determine if the store circuit is active, as evidenced by the store signal. If the store circuit is inactive no actions will be taken and the main loop will begin interation again. If the store circuit is active, the subroutine will determine various values associated with this preset.

The microprocessor will first read the current position from the height sensor 26 and store this value as RED #, where # will identify the associated indicator set number. The program then calculates the limits of the ranges which will trigger illumination of the various bulbs to provide the indications of relative distance, as discussed above. By adding to and subtracting from RED # a first constant C1, HIGRN and LOGRN values are determined. If the forks are beyond or outside of these values the appropriate one of the green bulbs will be illuminated. Similarly, and by adding to and subtracting from RED # a second constant C2, HIYLW and LOYLW values are determined. When the forks are beyond these limits, but within the HIGRN or LOGRN limits the appropriate yellow bulb is illuminated. Finally, when the forks are between the HIYLW and LOYLW limits both of the red bulbs are illuminated.

It is noted that the program will indicate that the stored height has been reached when the forks are within a predetermined distance above or below the position actually stored. This is due to the sensitivity of the height sensor. For example, if the height sensor measures to a hundredth of an inch, the user would have to move the forks to within one hundredth of an inch of the stored RED # position to actually match the stored position, which would be very difficult. As such, the HIYLW and LOYLW limits are determined based upon the sensitivity of the particular height sensor used, and provide a balance between accuracy and ease of use.

After calculating and storing the various range limits the subroutine changes an associated bit in the variable BIT to a 1 to indicate that this indicator set is active. Control is then transferred back to the main loop. This process may be continued for any or all of the remaining buttons 60, with a value for RED #, HIGRN #, HIYLW #, LOYLW #, and LOGRN # being calculated and stored for each button and the associated bit in BIT being set to a 1 to indicate that that indicator set has associated values. After each of these storage processes, control is returned to the main processing loop.

At this point it may be assumed that several positions corresponding to several of the buttons 60 have been stored in the manner described above. The operator will determine if he wishes to operate in a single display mode (mode one) or in a full display mode (mode two). Upon initialization the device will default to one or the other of the modes, preferably mode one, and the operator may switch between these modes by pressing the mode button 66. The difference between these modes is that in mode one the operator will choose a particular height display set by pressing the associated selection button 60, and only this height indicator set will be active and have the bulbs 52–56 illuminated. In mode two, however, all of the height indicators sets for which positions have been stored will be active.

During normal operation the program will make iterations through the main loop and portions of the subroutine. If the device is in mode one, pressing one of the selections switches 60 will cause an interrupt to the subroutine and cause PRESET to correspond to the particular button pressed. The main loop will also branch around the incrementation of PRESET to cause the program to only be considered with the single indicator. If the device is in mode two the main loop will increment PRESET to service all indicators.

Within the main loop the first action is to read the present position of the height sensor 26 from the quadrature decoder of the height sensor then possibly to perform calculations or checks to determine the validity of this reading. In particular, the program may check to see if the reading is beyond the maximum limits possible with the particular mast arrangement, may compare the reading to the last reading to ensure that there have been no jumps in readings, or may use other appropriate error detection routines. If an error is detected an off code will be loaded into the row or graphics driver to disable the height indicator sets, and thus signal the operator of a problem.

Where no error is found the program will then compare the present position with the yellow, green, and red range end points calculated during the storage and programming process. In particular, the microprocessor will go through various logic steps to determine if the present position is between the yellow positions, and thus "at" the stored height, is in the above yellow or above green position, or in the below yellow or below green position for the particular PRESET # under consideration. When the proper range has been found an appropriate code will be loaded into the row or graphics driver to illuminate the proper one of the bulbs to display such a condition. Thereafter the program will determine if this information which has been loaded should actually be displayed.

For this the program transfers into the subroutine by way of a software interrupt at a point below the reading of the switch encoder to determine the last of the buttons pressed, thus retaining the number of PRESET from the main loop. The subroutine first checks the variable BIT to see if all presets are devoid of associated values. If so, operation is restored to the main loop without additional steps, thus speeding program operation. As no action is taken regarding transfer of display information to the display driver for the bulbs, no bulbs are illuminated.

If any presets have associated values (i.e. BIT does not equal zero) the particular bit within BIT is checked to determine if associated values are stored for the preset number in question (i.e. BIT# does not equal zero). If values are stored the display information generated during the range determination is loaded and transferred to the display driver, thus activating the associated indicator set. Control is then returned to the main loop.

If the particular preset has no associated values stored, the next action depends upon the mode setting of the device. In mode one control will simply transfer to the main loop. As above, since no information is transferred to the display driver no information is displayed for the selected indicator set, or for any other indicator set. In mode two, however, an "off" code is loaded and transferred to the driver for that particular indicator set. Since several indicator sets may be active in mode two, this ensures that no information is displayed for those presets with no associated information. Control is then passed to the main loop to increment PRESET and begin the process again.

With this arrangement one or more of the height indicator sets will indicate the present position of the forks with respect to the PRESET position. In mode one the operator will choose one of the desired indicator sets, such that this indicator will display the desired information while the remaining indicators display no information. This will eliminate any possibility of confusion on the part of the operator. Alternatively, in mode two all of the indicators will be active such that the operator may consult the desired indicator to determine the relative position of the forks, without the need to remove his or her hands from the controls to press the desired one of the buttons 60.

An important feature of the present invention, is the provision of the multiple height indicator sets. With this arrangement the stored positions defined by the relatively small red range may be close together in the vertical direction, and the operator may receive an accurate indication for either or both of these predetermined heights. In particular, two adjacent PRESET heights may have a difference in position which is smaller than the absolute distance of the green, yellow, or even red range. This will allow the operator to accurately place loads upon shelves having a small, yet critical, height difference.

To further assist the operator, there may be provided an appropriate buzzer 68 on the display panel for producing an audible signal to the operator. As is known in the art, the buzzer 68 may sound one of several tones to indicate when one of the buttons has been pressed, thus providing an accurate indication for the programming and operation of the device. Additionally, the buzzer 68 may be employed in conjunction with, and in a similar manner to, the height indicator sets. In particular, it is preferred that when the forks enter either the high or low yellow ranges there is sounded a short tone by the buzzer 68 to indicate to the operator that the rate of progress of the forks should be slowed. When the position of the forks is within the relatively small range, a different tone, plural tones or a longer tone, is sounded by the buzzer 68 to indicate that progress of the forks should be stopped. This arrangement will allow the operator to more readily determine which of the height indicator sets is associated with the desired height, and/or to achieve the desired height without viewing the indicator sets, thus allowing the operator to closely observe the load carried by the forks.

Operation of the buzzer may be controlled by the software, and in particular the main loop during determination of the ranges. After the appropriate code to be sent to the display driver has been determined, a variable RANGE is assigned a corresponding code representing red, yellow or green. No designation is required for high or low in this example. However, prior to assigning the particular code to RANGE, if the current display code is yellow or red the loop will first determine if RANGE has a value representing a color outside of the color about to be assigned. For example, the yellow ranges are outside the red range and the green ranges are outside the yellow ranges.

If the current display code is yellow, but RANGE corresponds to green, the program has determied that the forks have just passed into the yellow range from the green range and will cause the buzzer to sound the short tone prior to changing RANGE to correspond to yellow. In a similar manner, when the display code is red but RANGE corresponds to yellow the program will cause the buzzer to sound the long tone.

The final remaining button is CLEAR button 64. Pressing this button will force the program to the beginning of the steps shown in the flow chart, thus resetting and clearing all of the stored heights and ranges.

Figure 3:
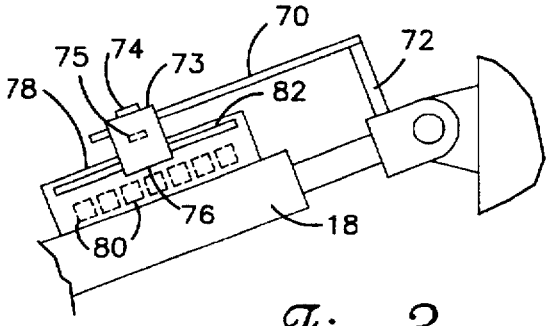
FIG. 3 is a side view showing a tilt sensor according to the present device.

Another feature of the present invention is the provision of a novel tilt sensor. As best shown in FIG. 3 the tilt sensor is generally designated by reference numeral 28 and is mounted upon the piston and cylinder combination 18. The sensor 28 includes an activator rod 70 mounted to the head of the piston by a spacer 72. The rod and spacer may be fixed to the piston by various means which will prevent relative movement between the rod and piston, including screws, although straps are preferred. The rod 70 extends toward the cylinder and includes a magnet housing 73 mounted near its free end.

The magnet housing includes a slot which receives the rod 70 therein for sliding movement, and a set screw 74 is employed to releasably fix the housing 72 to the rod 70 at positions along the rod. The housing mounts a magnet 75 therein and is formed of a material which will not unduly interfere with the flux field of the magnet, such as plastic. The lateral sides of the housing preferrably include outwardly extending parallel legs 76 having projections (not shown) extending toward the other of the legs for a reason discussed below.

Mounted upon the cylinder is a sensor box 78 elongated in the direction of rod 70 and also formed of a material which will not interfere with the field of the magnet 75. The box is mounted to the cylinder by means which will prevent relative movement of the box with respect to the cylinder, such as screws or straps. Mounted within the box are a plurality, preferably seven, Hall-effect transistors 80 spaced in the direction of rod 70 and having appropriate wiring extending from the box to allow the state of each transistor to be determined.

The box includes a pair of guide slots 82 extending along its lateral sides to receive the projections from the legs 76 of the magnet housing 73. As such, the magnet housing may slide along the length of the box, with the expansion and contraction of the piston with respect to the cylinder determining the relative position of the magnet with respect to the transistors. Variations in the tilt of the mast will therefore bring the magnet into operative proximity to various ones of the transistors, causing the transistors to change state. The particular transistor activated by the magnet for a given tilt position may be adjusted by adjusting the position of the housing 73 along the rod 70 and thereafter fixing set screw 74. It is preferred that the adjustments be so made that the central transistor is activated when the mast is in the vertical position.

Figure 4:
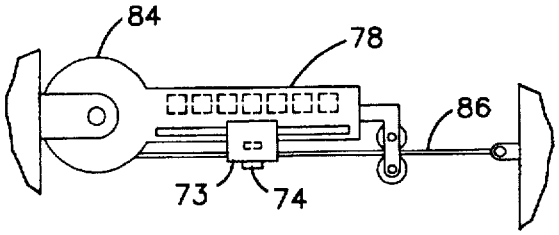
FIG. 4 is a side view showing a second embodiment of a tilt sensor according to the present device.

A second embodiment of a tilt sensor is shown in FIG. 4, where like elements are designated by like reference numerals. This embodiment employs the sensor box, transistors and sliding magnet housing, but the sensor box is mounted to or adjacent a tape reel 84 similar to reel 32 and having a biased tape 86 extending therefrom. The reel is mounted to one of the mast and chassis, and the free end of the tape is mounted to the other of the mast and chassis, such that the tape will extend in a taut condition between these elements.

The tape 86 will extend through the slot in the magnet housing and be releasably fixed therreto by the set screw 74. In this manner as the mast moves toward and away from the chassis the tape will retract and dispense from the reel, carrying the magnet with it to cause the magnet housing to slide with respect to the sensor box. To avoid a condition where the tape exerts a force upon the magnet housing tending to force it away from the box, interfering with smooth sliding, there may be provided one or more rollers 88 mounted to the sensor box and receiving the tape, thus maintaining the tape in a parallel relationship with the box along its extent.

As shown in FIG. 2, the display panel 44 may include a tilt display 86 comprised of a plurality of lights, with the number of lights preferably corresponding exactly to the number of transistors 82. As may be envisioned, each of the transistors 82 will be associated with one of the lights in the display 86, such that activation of the transistor 82 by the magnet 78 will cause the associated light to illuminate. This will provide the operator of an indication of the tilt of the mast.

As above with regard to the height indicator sets, the tilt display may include different colored lights to ease operator use. For example, the centermost light corresponding to a level condition could be red, while the immediately adjacent two lights could be yellow and the remaining outer lights green. This would provide an indication similar to the height indicator sets of the relative position of the tilt, and the desired rate of change of tilt to achieve level. While the tilt display need not form a part of the programmable control means for the height indicator sets, the tilt display may be part of such circuitry, or may simply be independently connected to the buzzer 68, such that the buzzer will sound an audible tone when the mast moves a predetermined angle from vertical to alert the operator of a potential hazard.

While the present invention has been described with regard to a particular embodiment, it will be apparent that modifications may be made without departing from the scope of the invention. For example, the display panel may be provided with a greater or a less number of indicator sets than that shown in the drawings. It is also possible to store a larger number of heights than indicator sets. For example, the device could include a page button(s), allowing the user to cycle through (or directly access) different pages of memory, with each page having available memory to store heights for the indicator sets in a manner similar to that described above. With this technique each button 60 could access numerous different heights, one for each page.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A position indicator for a forklift, the forklift having a chassis, a vertical mast mounted to the chassis for pivotal movement about a horizontal pivot axis, and a pair of lifting forks mounted to the mast for vertical movement thereon, comprising:

means, adapted to be mounted between the mast and the lifting forks, for sensing the position of the forks with respect to the mast and generating position signals indicating such position;

a controller connected to said sensing means and including a memory for storing information indicating a plurality of predetermined positions on said mast, said controller being operative for receiving said position signals, for comparing said signals with said information, and for generating display signals based upon the comparison of said signals and said stored information;

a display, having a plurality of sets of height indicators for providing an indication, to an operator of the forklift, of the position of the forks on said mast with respect to a selected one of said predetermined positions stored in said memory, each of said indicator sets including an above portion and spaced therefrom a below portion, means for selectively illuminating each of said portions in a first area and in a second area, said display being operative for receiving said display signals from said controller, said controller including means for illuminating said first area in said above portion of each said indicator set when the forks are above said selected one of said predetermined positions, and illuminating said first area in said below portion when the forks are below said selected one of said predetermined positions, and wherein each said above portion and said below portion of said sets of height indicators further includes means for simultaneously illuminating said second area in said above portion a first color when said forks are substantially located at said selected one of said predetermined positions, said first areas being independently illuminated a second color when said forks are not substantially located at, but are within a first selected distance from said selected one of said predetermined positions, and a third color when said forks are greater than said first selected distance from a predetermined position.

2. The position indicator as in claim 1, wherein said indicators are arranged with said above portion vertically above said below portion, thereby providing a visual indication of the position of the forks relative to the selected one of said predetermined positions.

3. The position indicator as in claim 2, wherein each of said above and below portions includes an apex pointing toward the other of said portions within each of said sets, thereby providing a visual indication of the direction of travel of the forks necessary to achieve the selected one of said predetermined positions.

4. The position indicator as in claim 1, further comprising means for sensing the angular position of the mast with respect to the chassis, and wherein said display is operatively connected to said means for sensing angular position and includes means for providing an indication, to an operator of the forklift, of the current angular position of said mast.

5. The position indicator as in claim 1, wherein each of said above and below portions includes an apex pointing toward the other of said portions within said set, thereby providing a visual indication of the direction of travel of the forks necessary to achieve the selected one of said predetermined positions.

6. The position indicator as in claim 1, wherein said first color is red, said second color is yellow, and said third color is green.

7. The position indicator as in claim 1 wherein said means to illuminate said above and below portions comprises a first light bulb for illuminating a first color when said forks are substantially at said predetermined position and a second light bulb for illuminating a second color when said forks are greater than a selected distance from said predetermined position.

* * * * *